US012768567B2

(12) United States Patent
TenEycke et al.

(10) Patent No.: US 12,768,567 B2
(45) Date of Patent: Oct. 20, 2026

(54) ELECTRIC PROCESS HEATER

(71) Applicant: Thermon Canada Inc., Edmonton (CA)

(72) Inventors: David TenEycke, Oakville (CA); Simon Chang, Ancaster (CA); David Johnston, Burlington (CA); Paul Moors, Edmonton (CA)

( * ) Notice: Subject to any disclaimer, the term of this patent is extended or adjusted under 35 U.S.C. 154(b) by 634 days.

(21) Appl. No.: 18/362,965

(22) Filed: Aug. 1, 2023

(65) Prior Publication Data

US 2025/0043992 A1 Feb. 6, 2025

(51) Int. Cl.
*F24H 1/10* (2022.01)
*F24H 9/00* (2022.01)

(52) U.S. Cl.
CPC ..... *F24H 1/103* (2013.01); *F24H 9/0021* (2013.01)

(58) Field of Classification Search
CPC .. F28F 9/22; F28F 2009/226; F28F 2009/224; F28F 2009/222; F24H 1/103; F24H 9/0015; F24H 9/0021; F24H 1/102; F24H 1/101; F24H 2250/00; F24H 2250/02; F24H 9/02; F24H 9/1818; F24H 9/2028; F28D 2021/0022; F28D 2021/0052; F28D 7/06; F28D 7/1615; F28D 7/00; F28D 7/085; F28D 7/16; H05B 2203/007; H05B 2203/021; H05B 2203/037; H05B 3/06; H05B 3/42; H05B 3/48; H05B 3/82
USPC ..... 159/901; 165/159, 162 DIG, 416; 29/890.047
See application file for complete search history.

(56) References Cited

U.S. PATENT DOCUMENTS

2011/0094720 A1* 4/2011 Wang ..... F28D 7/1607 165/161
2019/0063853 A1* 2/2019 Tatavarthy ..... F28F 9/22
2022/0236014 A1* 7/2022 Streiff ..... F28D 7/06

* cited by examiner

*Primary Examiner* — Vy T Nguyen

(57) ABSTRACT

Disclosed herein is an electric process heater having a vessel containing a fluid, a plurality of elongated heating elements extending inside the vessel parallel to a central axis of the electric process heater, wherein the heating elements comprise fins. Baffles are disposed at axial intervals inside the electric process heater to redirect the flow of fluid over the heating elements to provide improved heat transfer between the heating elements and the fluid inside the vessel. The baffles include flow-through heating element support holes for receiving and supporting the elongated heating elements. Each of the plurality of flow-through heating element support holes has a plurality of element-contacting tabs that protrude radially inwardly to support the heating elements within the baffles. The tabs define a plurality of gaps through which the fluid flows between the baffles and the heating elements to reduce a thermal differential at a heating element-baffle interface.

8 Claims, 11 Drawing Sheets

ELECTRIC PROCESS HEATER

TECHNICAL FIELD

The present invention relates to electric process heaters and more particular to electric process heaters that have baffles.

BACKGROUND

Electric process heaters have been used for many years in various industries. The design of many process heaters typically involves the use of tubular metal-sheathed heating elements formed into a hairpin shape in which one or more heating elements are arranged in a heating bundle and placed inside a fluid-containment piping system. Although many such designs are known in the art, there remains a need in the industry to improve the effective heat transfer rate of heat produced by the electric heater to the fluid being heated. Many electric process heaters use baffles to redirect the flow of fluid (liquid or gas) over the heating elements to provide improved heat transfer between the heating element and the fluid. However, it has been found that some locations on the baffle may become excessively hot, resulting in degraded performance and shortened lifespan for the heater.

An improved electric process heater is thus highly desirable.

SUMMARY

The following presents a simplified summary of some aspects or embodiments of the invention in order to provide a basic understanding of the invention. This summary is not an extensive overview of the invention. It is not intended to identify key or critical elements of the invention or to delineate the scope of the invention. Its sole purpose is to present some embodiments of the invention in a simplified form as a prelude to the more detailed description that is presented later.

The present specification discloses an electric process heater comprising a vessel containing a fluid, a plurality of elongated heating elements extending inside the vessel parallel to a central axis of the electric process heater. The heater includes a plurality of baffles disposed at axial intervals inside the electric process heater to redirect the flow of fluid over the heating elements to provide improved heat transfer between the heating elements and the fluid. Each of the plurality of baffles includes flow-through heating element support holes for receiving and supporting the elongated heating elements. Each of the plurality of flow-through heating element support holes has a plurality of element-contacting tabs that protrude radially inwardly to support the heating elements within the baffles, wherein the tabs define a plurality of gaps through which the fluid flows between the baffles and the heating elements to reduce a thermal differential at a heating element-baffle interface.

The present specification also discloses a baffle comprising a plurality of flow-through heating element support holes for receiving and supporting elongated heating elements that transfer heat to the fluid. Each of the plurality of flow-through heating element support holes has a plurality of element-contacting tabs that protrude radially inwardly to support the heating elements within the baffle. The tabs define a plurality of gaps through which the fluid flows between the baffle and the heating elements to reduce a thermal differential at a heating element-baffle interface.

The present specification further discloses an electric process heater comprising a vessel containing a fluid, a plurality of elongated heating elements extending inside the vessel parallel to a central axis of the electric process heater, wherein the heating elements comprise fins. The heater also includes a plurality of baffles disposed at axial intervals inside the electric process heater to redirect the flow of fluid over the heating elements to provide improved heat transfer between the heating elements and the fluid. Each of the plurality of baffles includes flow-through heating element support holes for receiving and supporting the elongated heating elements. Each of the plurality of flow-through heating element support holes has a plurality of element-contacting tabs that protrude radially inwardly to support the heating elements within the baffles, wherein the tabs define a plurality of gaps through which the fluid flows between the baffles and the heating elements to reduce a thermal differential at a heating element-baffle interface.

BRIEF DESCRIPTION OF THE DRAWINGS

These and other features of the disclosure will become more apparent from the description in which reference is made to the following appended drawings.

DETAILED DESCRIPTION OF EMBODIMENTS

The following detailed description contains, for the purposes of explanation, numerous specific embodiments, implementations, examples and details in order to provide a thorough understanding of the invention. It is apparent, however, that the embodiments may be practiced without these specific details or with an equivalent arrangement. In other instances, some well-known structures and devices are shown in block diagram form in order to avoid unnecessarily obscuring the embodiments of the invention. The description should in no way be limited to the illustrative implementations, drawings, and techniques illustrated below, including the exemplary designs and implementations illustrated and described herein, but may be modified within the scope of the appended claims along with their full scope of equivalents.

Figure 1:
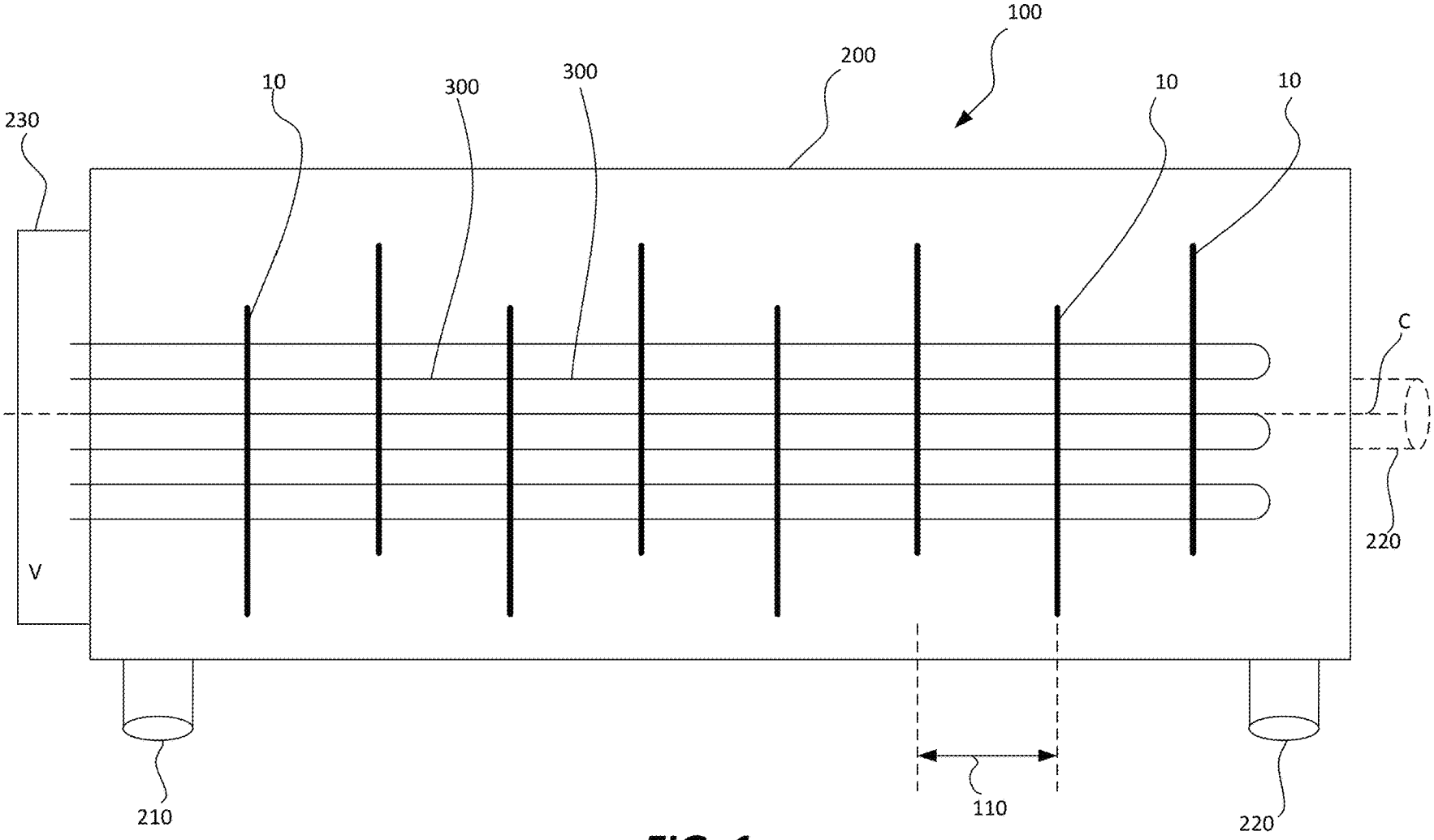
FIG. 1 is a schematic side view of an electric process heater having a plurality of no-tube-in-window baffles in accordance with an embodiment of the present invention.
Figure 2:
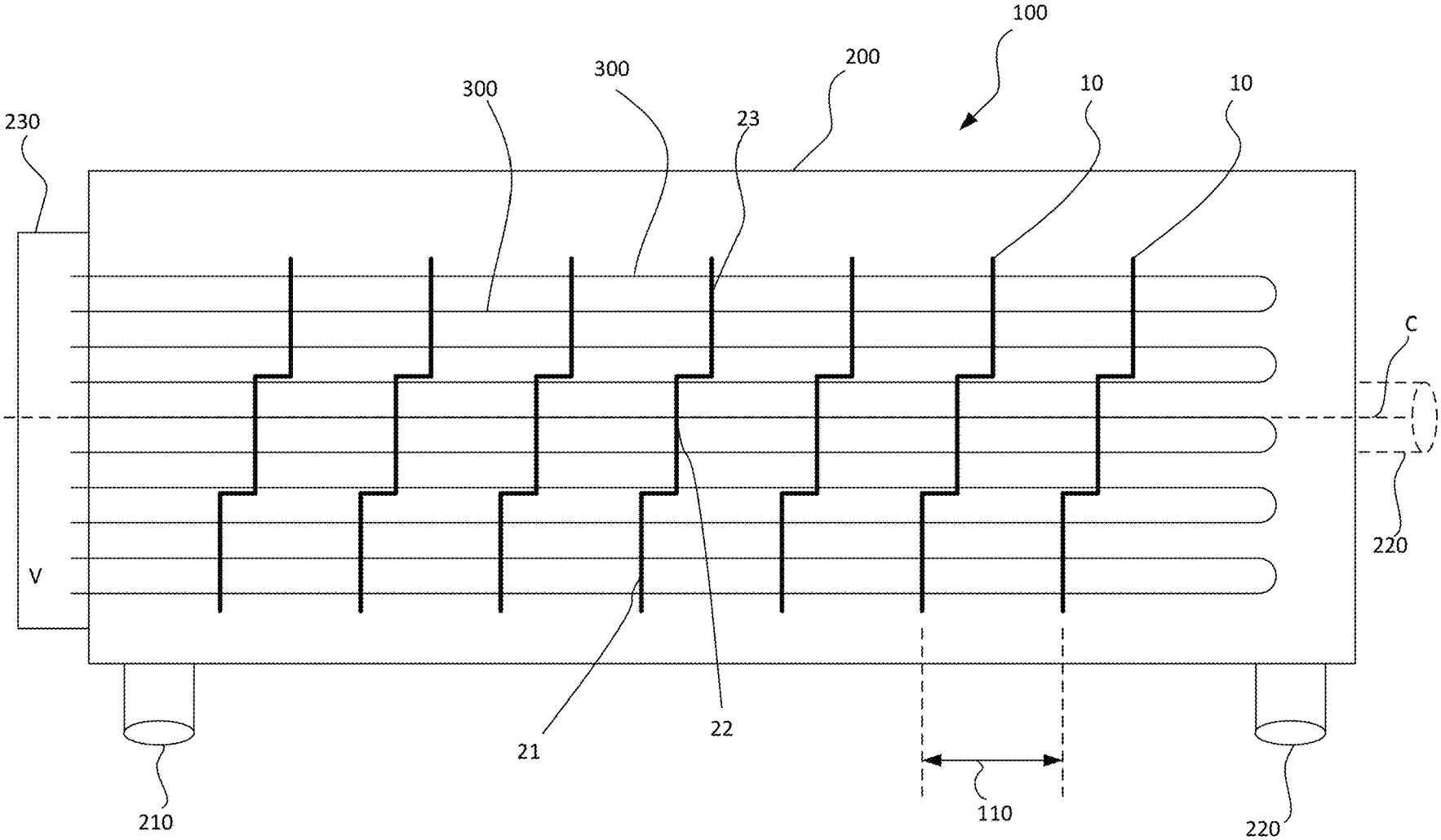
FIG. 2 is a schematic side view of an electric process heater having a plurality of stepped segmental baffles in accordance with an embodiment of the present invention.
Figure 3:
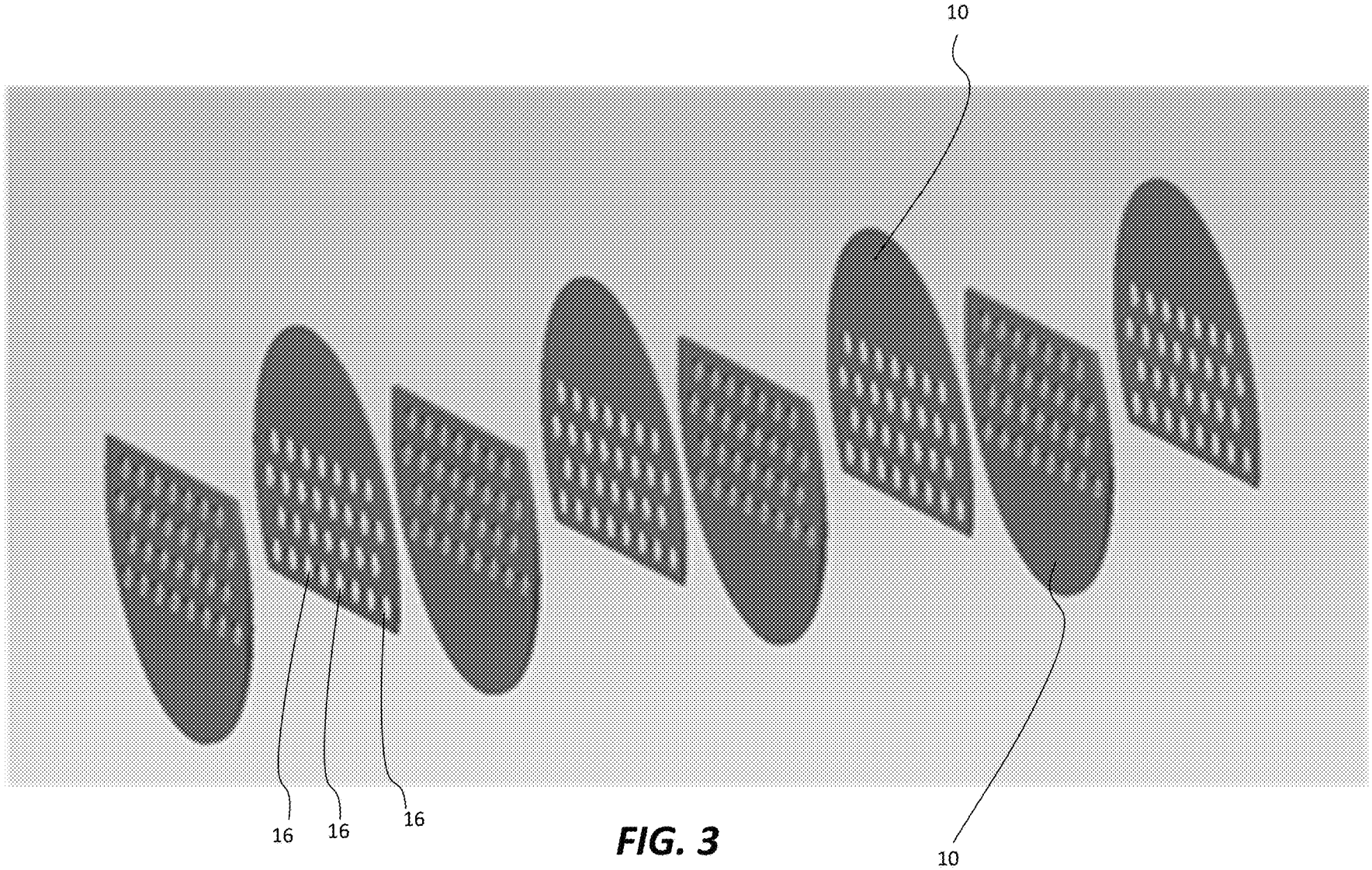
FIG. 3 is a perspective view of a plurality of no-tube-in-window baffles that may be used in the electric process heater in accordance with another embodiment of the present invention.
Figure 4:
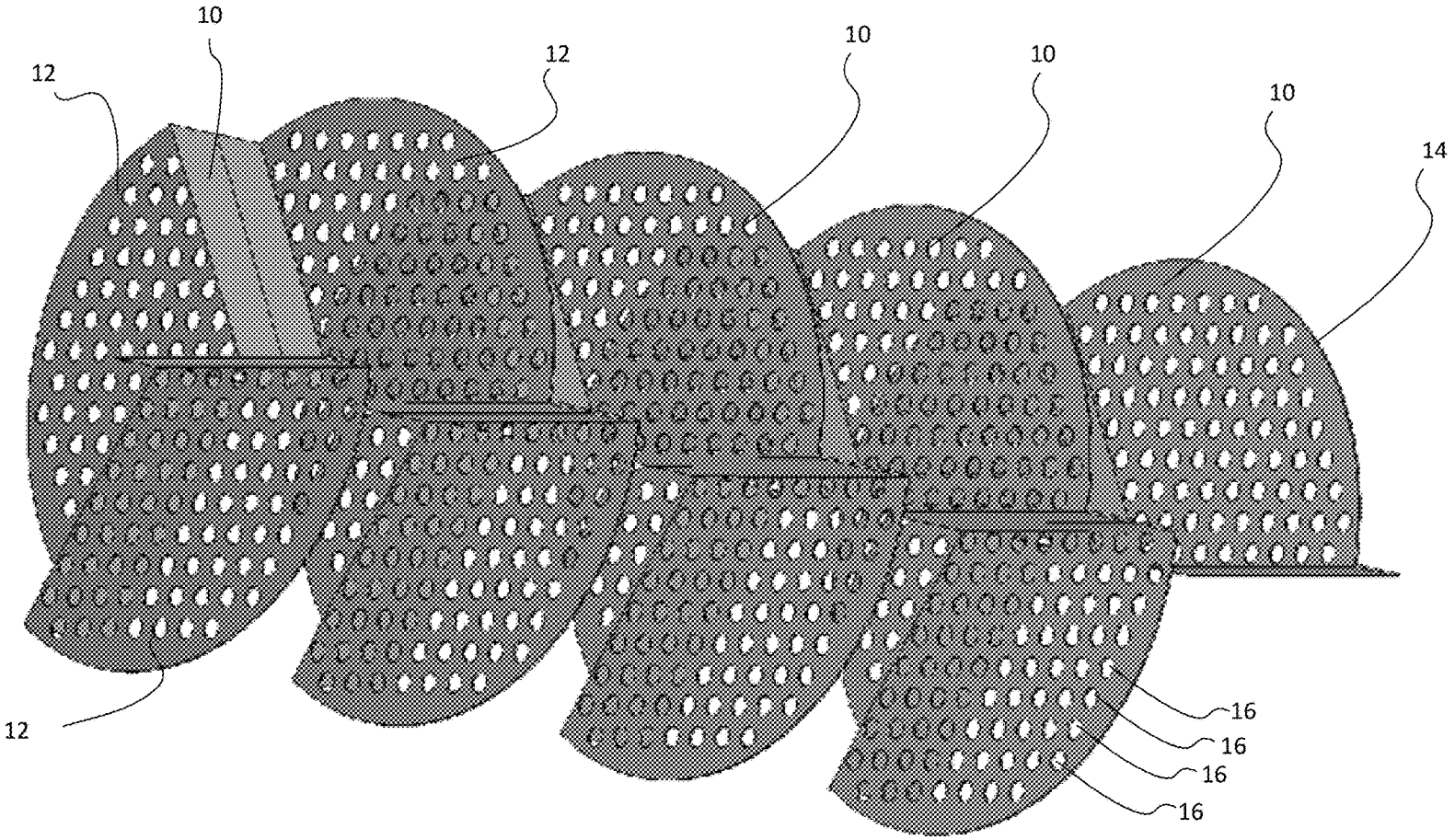
FIG. 4 is a perspective view of stepped segmental baffles that may be used in the electric process heater in accordance with an embodiment of the present invention.
Figure 5:
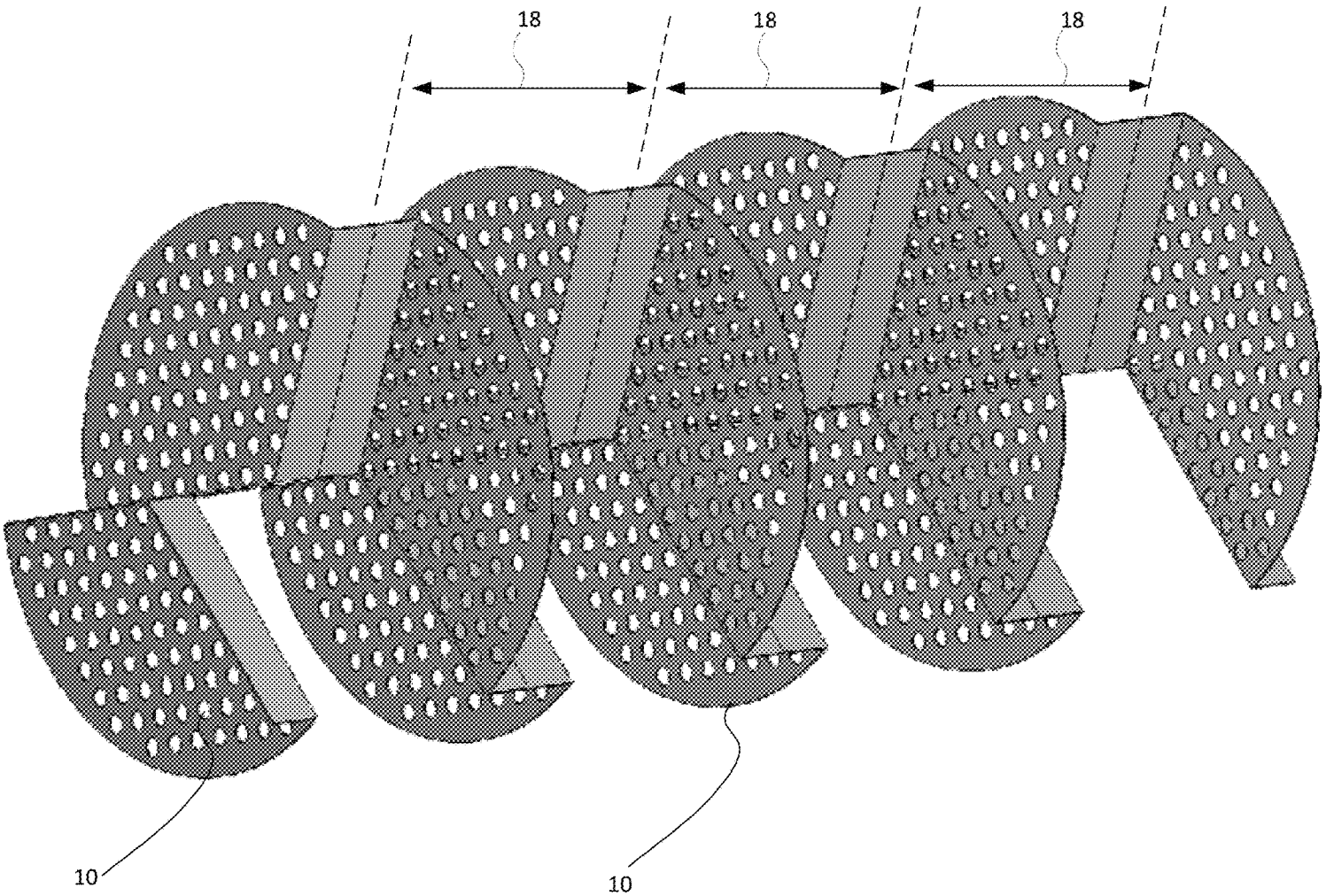
FIG. 5 is another perspective view of stepped segmental baffles.
Figure 6:
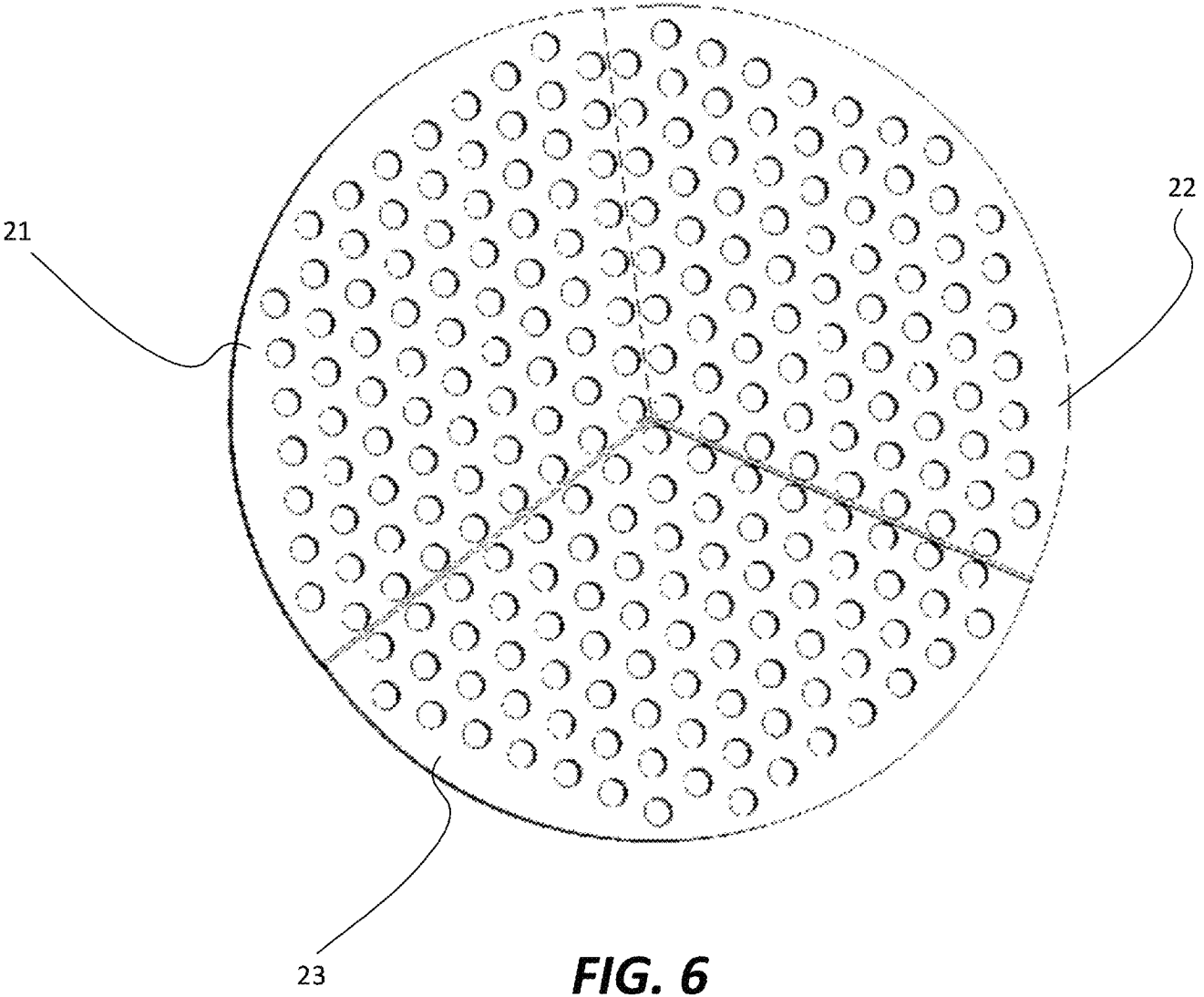
FIG. 6 is an end view a stepped segmental baffle.
Figure 7:
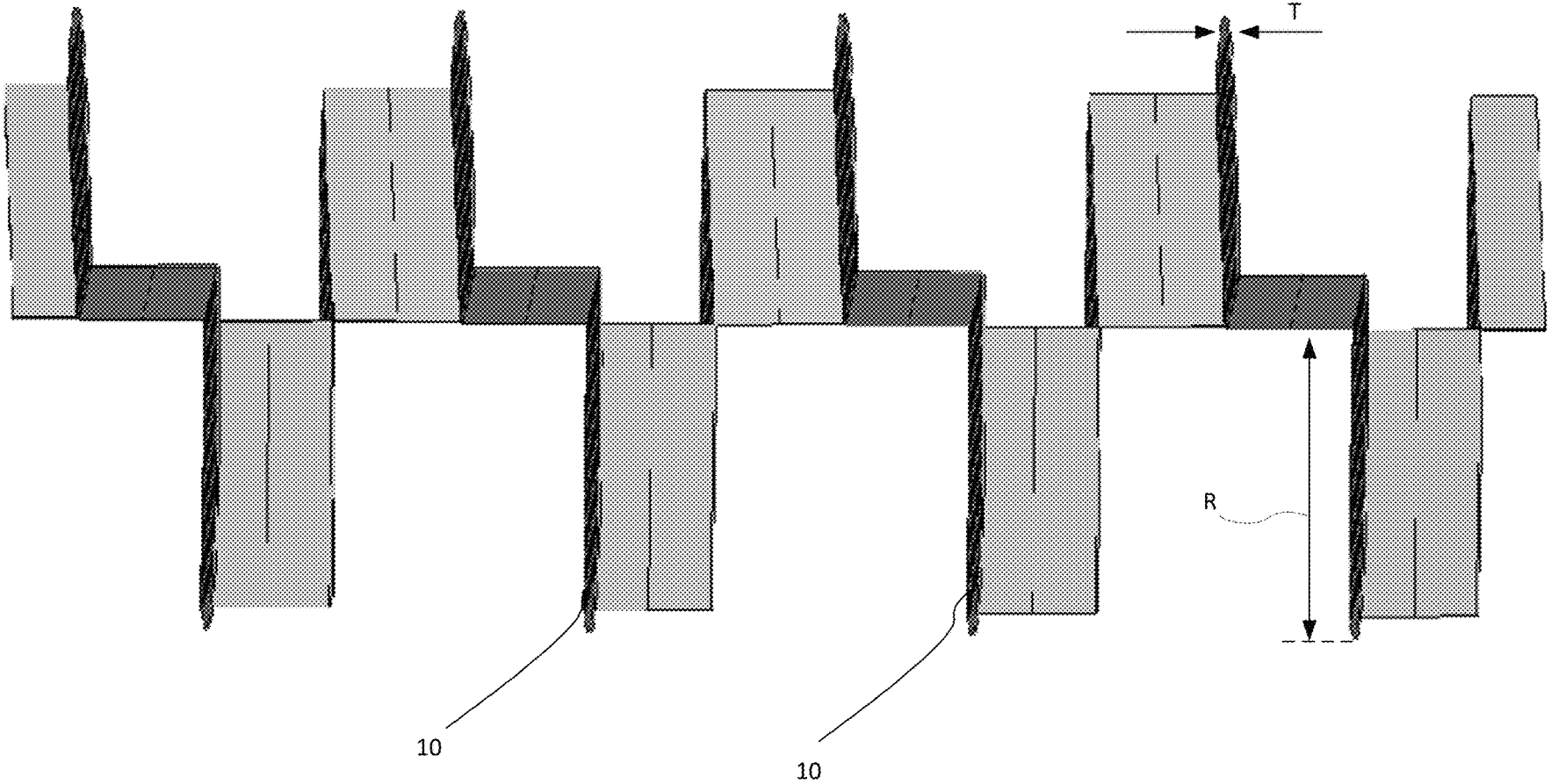
FIG. 7 is another perspective view of stepped segmental baffles.
Figure 8:
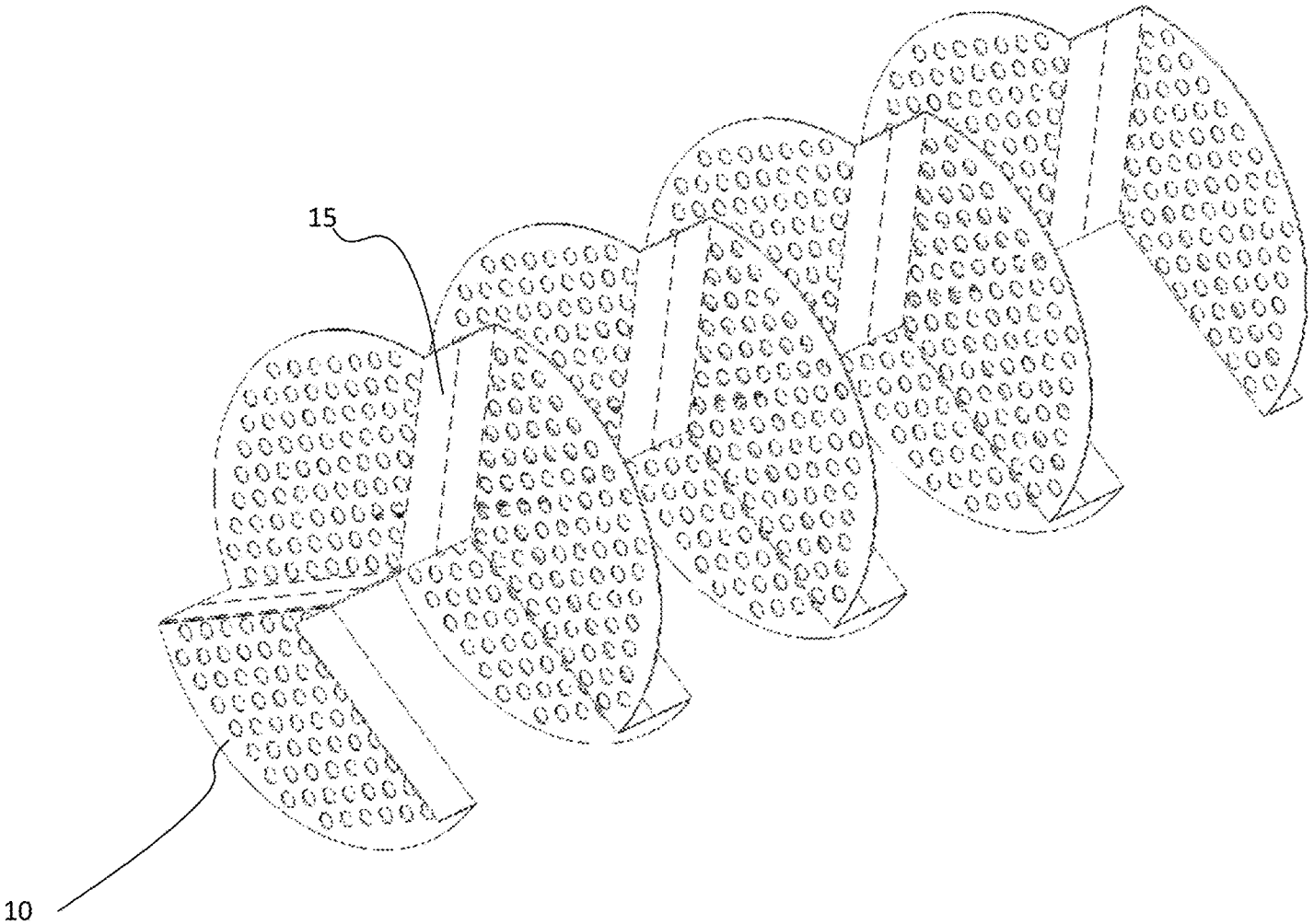
FIG. 8 is another perspective view of stepped segmental baffles.

FIG. 1 is a schematic side view of an electric process heater having a plurality of no-tube-in-window baffles in accordance with an embodiment of the present invention. The electric process heater includes a heat exchanger in which the baffles act to redirect the flow of fluid over the heating elements to provide improved heat transfer between the heating elements and the fluid. FIG. 2 is a similar schematic side view of the electric process heater in which the baffles are stepped segmental baffles in accordance with a more specific embodiment of the present invention. In another embodiment, the electric process heater includes no-tube-in-window (NTIW) baffles 10 as shown in FIGS. 1 and 3. The NTIW baffles 10 of FIG. 3 have a plurality of holes (or perforations) 16 through which elongated heating elements extend. The electric process heater may incorporate other types of baffles like disk-and-donut baffles, segmental baffles, spiral baffles, and helical baffles. As will be described below, in various embodiments of the present invention, the electric process heater has baffles that include flow-through heating element holes that permit the fluid inside the heater to flow at an interface of the baffle and heating element to prevent localized overheating. The heating elements may also have fins.

In the embodiment depicted by way of example in FIG. 1, an electric process heater denoted generally by reference numeral 100 includes a fluid-containment vessel 200 containing a fluid and a plurality of elongated heating elements 300 extending inside the vessel parallel to a central axis C of the electric process heater that loop back in a hairpin arrangement as shown. The vessel 200 has a fluid inlet 210 and a fluid outlet 220. The fluid inlet 210 may be disposed on the side of the vessel as shown. Likewise, the fluid outlet 220 may be disposed on the side of the vessel. Alternatively, the fluid outlet 220 may be disposed on the end of the vessel as shown in dashed lines in FIGS. 1 and 2. It is also possible to reverse the fluid inlet and fluid outlet so that the fluid flows in the opposite direction. The electric process heater 100 also has a wiring junction box denoted by reference numeral 230. In the embodiments of FIGS. 1 and 2, all of the heating element connections are disposed at one end and extend through a piping flange attached to the vessel into the wiring junction box 230 to simplify electrical connections of the heating elements. The vessel 200 may alternatively be a closed tank without the fluid inlet and fluid outlet. The elongated heating elements 300 may be electrical heating elements, i.e. electrically resistive heating elements that generate heat when electric current flows through a resistor, wire, ribbon, or equivalent. Any suitable electrically resistive wire, ribbon or material may be used for the electric heating element such as, for example, nickel-chrome alloy or any functionally equivalent material capable of generating heat by resistance. In the illustrated embodiment, a voltage source V (or power source), which may be incorporated in the junction box 230, generates the electric current for the electrical heating elements. The electric process heater includes a plurality of baffles 10. e.g. no-tube-in-window baffles, disposed at axial intervals 110 inside the electric process heater to redirect the flow of fluid over the heating elements to provide improved heat transfer between the heating elements and the fluid.

The electric process heater 100 may be an immersion-type heater in which the heating elements are immersed in a fluid to be heated. The electric process heater may also be used or adapted for use in other types of heaters such as flange heaters, pressurized heaters, circulation heaters, etc. The electric process heater may be used in various heating applications for heating a fluid (liquid or gas) for various purposes such as, for example, temperature regulation, freeze protection, vaporization/boiling, stabilizing a condensate, reducing viscosity of a liquid, etc.

FIG. 2 depicts the electric process heater 100 in which the baffles are stepped segmental baffles 10. As described below, stepped segmental baffles provide particularly superior performance and are easier to manufacture than helical or spiral baffles. Alternatively, in another embodiment that also provides excellent performance, a plurality of no-tube-in-window baffles 10 may be used in the electric process heater. FIG. 3 shows a plurality of no-tube-in-window (NTIW) baffles 10 having holes 16. Other configurations of NTIW baffles may be used with different numbers or patterns of holes to accommodate different number or arrangements of heating elements.

FIGS. 4 to 8 are views of a stepped segmented baffle that may be used advantageously in the electric process heater 100 of FIG. 2 in accordance with a particular embodiment of the present invention.

As shown by way of example in FIGS. 4 to 8, the stepped segmental baffle 10 has a plurality of stepped segments 12 defined by a flat structure 14 that includes a plurality of perforations 16 through which elongated heating elements extend as depicted by way of example in the schematic illustration of an electric process heater in FIG. 2. In the embodiment illustrated in these figures, the stepped segments 12 are disposed orthogonally relative to a central axis C of the electric process heater. The stepped segments 12 are spaced apart from each other by an axial distance 18. As such, the stepped segments 12 are parallel to each other. The stepped segments 12 are supported by perpendicularly disposed segment support 15 which define surfaces that are orthogonal to the stepped segments 12 as shown in the figures.

In one specific embodiment, illustrated by way of example in FIGS. 4 to 8, the stepped segmented baffle 10 has a first stepped segment 21, a second stepped segment 22 and a third stepped segment 23. In another embodiment, the baffle 10 may have more than three stepped segments, e.g. four stepped segments, five stepped segments, six stepped segments, etc.

In one specific embodiment, illustrated by way of example in the figures, the first stepped segment 21, the second stepped segment 22 and the third stepped segment 23 have identical shapes.

In one specific embodiment, illustrated by way of example in the figures, the first stepped segment 21, the second stepped segment 22 and the third stepped segment 23 each define 120-degree sectors. When viewed from the end, therefore, the baffle covers 360 degrees. In another embodiment having four stepped segments, each sector would define 90-degree sectors. In another embodiment having five stepped segments, each sector would define 72-degree sectors. In another embodiment having six stepped segments, each sector would define 60-degree sectors. More than six sectors is also possible in other variants. In these embodiments, each sector is identical; however, in yet further embodiments, the sectors may be different (unequal) in size and/or angular span. In the embodiments described so far, the segments of a given baffle cover 360 degrees as noted above; however, in other embodiments, it may be possible to have segments that cover more than 360 degrees or less than 360 degrees.

In one specific embodiment, illustrated by way of example in FIGS. 4 to 8, the stepped segments 12 extend radially outward from the central axis C by a radial distance R greater than the axial distance. In the illustrated embodiment, the radial distance R of each segment is the same; however, in other embodiments, it may be possible to have segments of different radius, e.g. different radii R1, R2, R3.

In the embodiment illustrated by way of example in FIGS. 4 to 8, a thickness T of each one of the stepped segments is less than the axial distance.

In one specific embodiment, illustrated by way of example in the figures, the first stepped segment 21, the second stepped segment 22 and the third stepped segment 23 have the same number of perforations 16. Such an arrangement provides radial symmetry for the bundle(s) of heating elements inside the vessel. In another embodiment, however, it may be useful for some specific reason or application to provide a different number of perforations 16 on each segment. Similarly, as shown in the figures, the perforations 16 are all the same size (same diameter) in order to accommodate heating elements having a uniform diameter.

In one specific embodiment, illustrated by way of example in the figures, the axial distance between the first segment 21 and the second segment 22 is the same as the axial distance between the second segment 22 and the third segment 23. In another embodiment, the axial distance may be different. The stepped segmental baffle 10 can be made with varying axial distance (pitch) between the steps of the baffle to optimize the heater performance.

The stepped segmented baffle 10 may be manufactured, for example, by separately making each of the segments 12 and then joining the segments together to form the baffle. The stepped segmented baffle is thus easier and less expensive to manufacture than a spiral baffle or a helical baffle. The stepped baffle design with segments being orthogonal to the central axis provides excellent flow characteristics that in turn improve the heat transfer efficiency of the heater.

The baffles 10 may also be used in another type of heat exchanger such as a fluid-to-fluid heater or heat exchanger in which the heating elements are fluid-carrying tubes instead of electric heating elements. In other words, the baffles 10 may be used, or adapted for use, in other types of heat exchangers such as shell-and-tube heat exchanger in which a first fluid is carried through tubes inside a shell (vessel). The tubes extend through holes in baffles to exchange heat with a surrounding second fluid. It will be appreciated that this novel baffle design may find applications and uses in various other types of heat exchangers.

Figure 9:
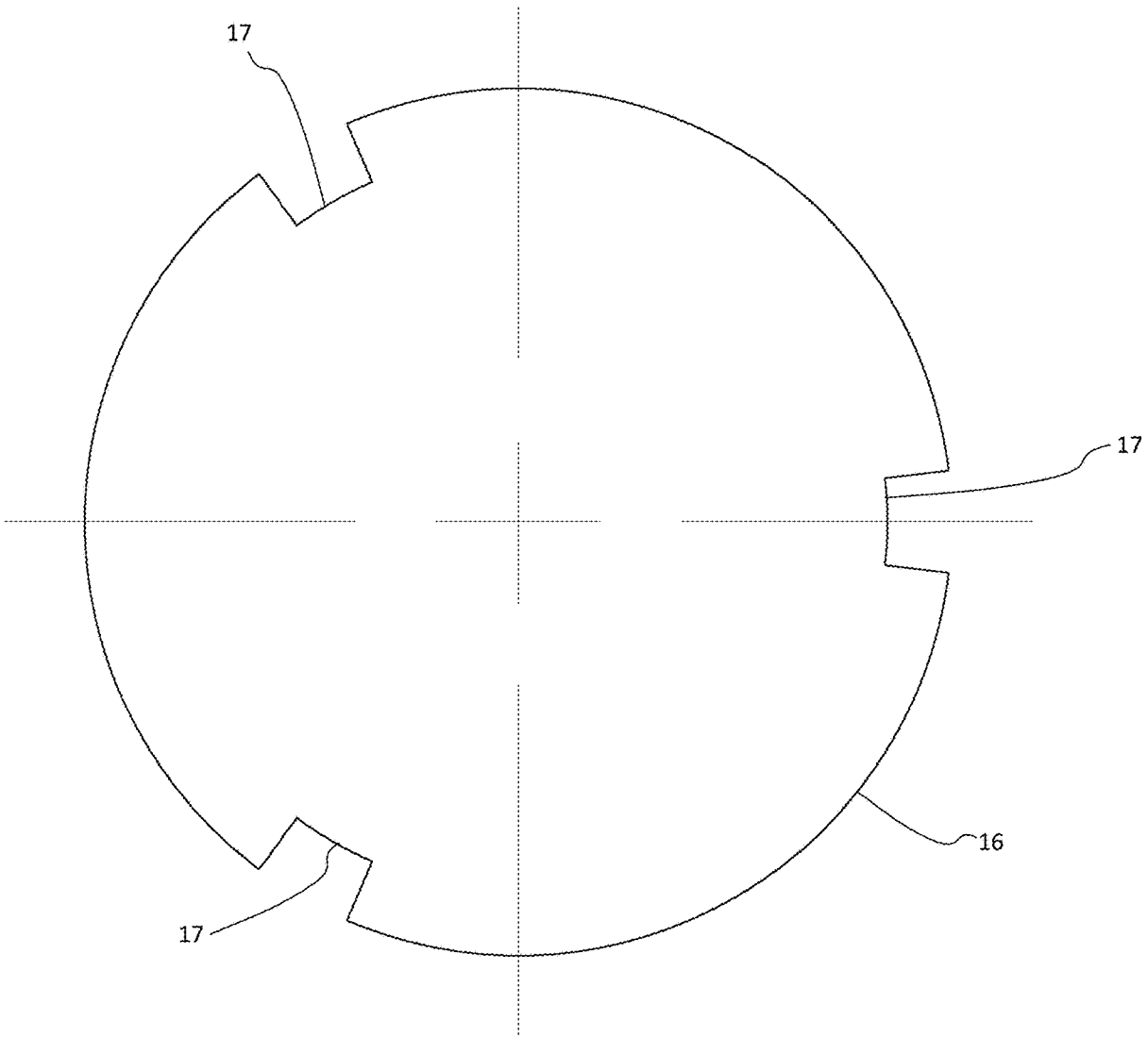
FIG. 9 is an enlarged view of a flow-through heating element support hole of a baffle in accordance with an embodiment of the present invention.
Figure 10:
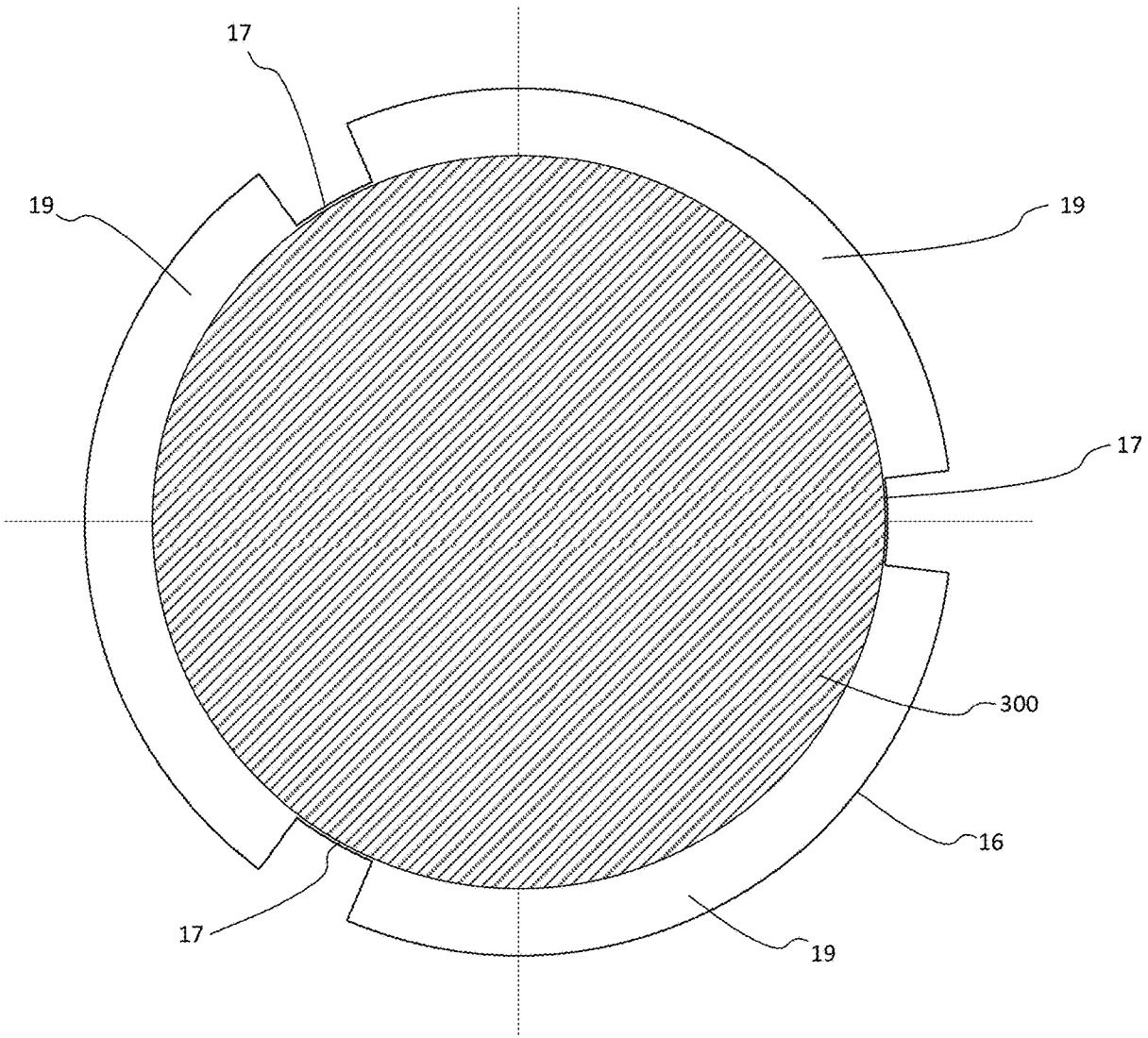
FIG. 10 is an enlarged view of a flow-through heating element support hole of a baffle showing the gap at the interface between the baffle and the heating element.

FIG. 9 is an enlarged view of a flow-through heating element support hole 16 of a baffle in accordance with an embodiment of the present invention. As described and illustrated, each baffle has a plurality of such holes 16 designed to receive and support the elongated heating elements. The holes 16 of each baffle are aligned with the holes of the other baffles so that the elongated heating elements can fit straight through these holes. The novel flow-through heating element support hole 16 receives and supports the elongated heating elements while providing a flow-through design for fluid to cool the interface of the heating element and baffle in order to prevent localized hot spots. Each of the plurality of flow-through heating element support holes 16 as shown in FIGS. 9 and 10 has a plurality of element-contacting tabs 17 that protrude radially inwardly to support the heating elements 300 within the baffles 10. The tabs 17 define a plurality of gaps 19 through which the fluid flows between the baffles 10 and the heating elements 300 to reduce a thermal differential at a heating element-baffle interface FIG. 9 shows the hole 16 in isolation. FIG. 10 is an enlarged view of the flow-through heating element support hole 16 with the heating element 300 inside, showing the gap 19 at the interface between the baffle and the heating element 300. The gap enable fluid to flow along the surface where the baffle meets the heating element (referred to herein as the heating element-baffle interface). The fluid flow cools the interface, preventing localized overheating and thus extending the life span of the electric process heater.

In one embodiment each of the flow-through heating element support holes 16 comprises three equally spaced tabs. In another embodiment, there may be 2 tabs, 4 tabs, 5 tabs or another number of tabs. In the illustrated embodiment, the tabs 17 define an angular arc that is less than an angular arc defined by each of the gaps 19. In another embodiment, the gaps may span an equal or smaller angular arc than the tabs. In the illustrated embodiment, the tabs are equal in size and shape. In another embodiment, the tabs may be different sizes and/or different shapes to accommodate for example a non-circular or asymmetrical heating element. In a main embodiment, the tabs are made of the same material as the rest of the baffle. In another embodiment, the tabs may be made of a different material. The tabs may have the same thickness as the rest of the baffle although in a variant the tabs may have a different thickness. In most embodiments, each hole 16 of each baffle is a flow-through heating element support hole; however, it is possible in some other embodiments that only a subset of the holes 16 are flow-through heating element support holes.

Figure 11:
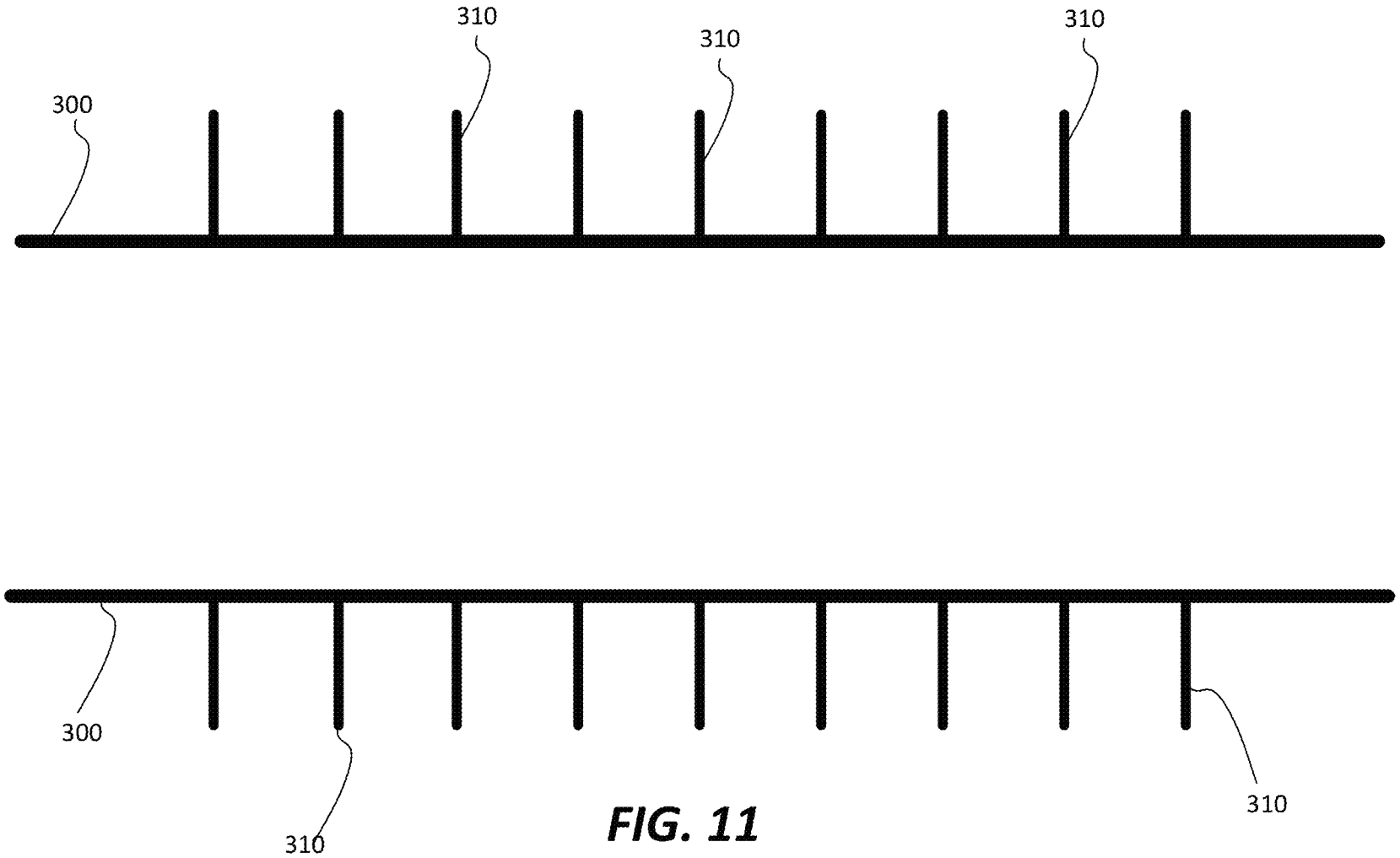
FIG. 11 is an enlarged view of a heating element having fins in accordance with an embodiment of the present invention.

In one embodiment, the heating elements 300 have fins 310. The fins may extend over substantially all of the length of the heating elements or only over portions of the heating elements. FIG. 11 is an enlarged view of a segment of a heating element 300 having fins 310 in accordance with an embodiment of the present invention. The fins 310 may be of equal size and shape or they may be of differing size and shape. Likewise, the spacing between fins may be constant or varying.

It is to be understood that the singular forms "a", "an" and "the" include plural referents unless the context clearly dictates otherwise. Thus, for example, reference to "a device" includes reference to one or more of such devices, i.e. that there is at least one device. The terms "comprising", "having", "including", "entailing" and "containing", or verb tense variants thereof, are to be construed as open-ended terms (i.e., meaning "including, but not limited to,") unless otherwise noted. All methods described herein can be performed in any suitable order unless otherwise indicated herein or otherwise clearly contradicted by context. The use of examples or exemplary language (e.g. "such as") is intended merely to better illustrate or describe embodiments of the invention and is not intended to limit the scope of the invention unless otherwise claimed.

While several embodiments have been provided in the present disclosure, it should be understood that the disclosed systems and methods might be embodied in many other specific forms without departing from the scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the inventive concept(s) disclosed herein.

The invention claimed is:

1. An electric process heater comprising:

a vessel containing a fluid;

a plurality of elongated heating elements extending inside the vessel parallel to a central axis of the electric process heater;

a plurality of baffles disposed at axial intervals inside the electric process heater to redirect a flow of the fluid over the elongated heating elements to provide improved heat transfer between the elongated heating elements and the fluid inside the vessel; and wherein each of the plurality of baffles includes flow-through heating element support holes for receiving and supporting the elongated heating elements;

wherein each of the plurality of flow-through heating element support holes has a plurality of element-contacting tabs that protrude radially inwardly to support the heating elements within the baffles, wherein the tabs define a plurality of gaps through which the fluid flows between the baffles and the heating elements to reduce a thermal differential at a heating element-baffle interface, wherein the tabs define an angular arc that matches a curvature of the heating element.

2. The electric process heater of claim 1 wherein each of the flow-through heating element support holes comprises three equally spaced tabs.

3. The electric process heater of claim 1 wherein the angular arc of the tabs is less than an angular arc defined by each of the gaps.

4. A baffle comprising:

a plurality of flow-through heating element support holes for receiving and supporting elongated heating elements that transfer heat to a fluid;

wherein each of the plurality of flow-through heating element support holes has a plurality of element-contacting tabs that protrude radially inwardly to support the heating elements within the baffle, wherein the tabs define a plurality of gaps through which the fluid flows between the baffle and the heating elements to reduce a thermal differential at a heating element-baffle interface, wherein the tabs define an angular arc that matches a curvature of the heating element.

5. The baffle of claim 4 wherein each of the flow-through heating element support holes comprises three equally spaced tabs.

6. The baffle of claim 5 wherein the tabs-define an angular arc of the tabs is less than an angular arc defined by each of the gaps.

7. An electric process heater comprising:

a vessel containing a fluid;

a plurality of elongated heating elements extending inside the vessel parallel to a central axis of the electric process heater, wherein the heating elements comprise fins;

a plurality of baffles disposed at axial intervals inside the electric process heater to redirect a flow of the fluid over the elongated heating elements to provide improved heat transfer between the elongated heating elements and the fluid inside the vessel; and wherein each of the plurality of baffles includes flow-through heating element support holes for receiving and supporting the elongated heating elements;

wherein each of the plurality of flow-through heating element support holes has a plurality of element-contacting tabs that protrude radially inwardly to support the heating elements within the baffles, wherein the tabs define a plurality of gaps through which the fluid flows between the baffles and the heating elements to reduce a thermal differential at a heating element-baffle interface wherein the tabs define an angular arc that matches a curvature of the heating element.

8. The electric process heater of claim 7 wherein each of the flow-through heating element support holes comprises three equally spaced tabs and wherein the angular arc of the tabs is less than an angular arc defined by each of the gaps.

* * * * *